US010914183B2

(12) United States Patent
Rustad et al.

(10) Patent No.: US 10,914,183 B2
(45) Date of Patent: Feb. 9, 2021

(54) EROSION RESISTANT BLADES FOR COMPRESSORS

(71) Applicant: OneSubsea IP UK Limited, London (GB)

(72) Inventors: Rolf Rustad, Raadal (NO); Bernt Helge Torkildsen, Bergen (NO); Nicolas Butin, Bergen (NO); Christopher Nwakwuo, Bergen (NO); Marius Askevold, Bergen (NO)

(73) Assignee: OneSubsea IP UK Limited, London (GB)

( * ) Notice: Subject to any disclaimer, the term of this patent is extended or adjusted under 35 U.S.C. 154(b) by 16 days.

(21) Appl. No.: 16/161,125

(22) Filed: Oct. 16, 2018

(65) Prior Publication Data

US 2019/0112933 A1 Apr. 18, 2019

Related U.S. Application Data

(60) Provisional application No. 62/572,978, filed on Oct. 16, 2017.

(51) Int. Cl.

| | |
|---|---|
| ***F04D 29/32*** | (2006.01) |
| ***F01D 5/28*** | (2006.01) |
| ***F04D 29/02*** | (2006.01) |
| ***F04D 19/02*** | (2006.01) |
| ***C23C 30/00*** | (2006.01) |

(52) U.S. Cl.

CPC ..... *F01D 5/288* (2013.01); *C23C 30/00* (2013.01); *F04D 19/024* (2013.01); *F04D 29/023* (2013.01); *F04D 29/324* (2013.01); *F05B 2230/90* (2013.01); *F05D 2230/31* (2013.01); *F05D 2300/2263* (2013.01); *F05D 2300/2281* (2013.01); *F05D 2300/2284* (2013.01); *F05D 2300/611* (2013.01)

(58) Field of Classification Search

None

See application file for complete search history.

(56) References Cited

U.S. PATENT DOCUMENTS 4,576,874 A * 3/1986 Spengler ..... C23C 4/02 428/623
6,095,755 A * 8/2000 Houston ..... F01D 5/288 416/224

(Continued)

FOREIGN PATENT DOCUMENTS

WO 2014083055 A2 6/2014
WO 2017012761 A1 1/2017

OTHER PUBLICATIONS

Extended European Search Report issued in European Patent Appl. No. 18200737.7 dated Mar. 14, 2019; 6 pages.

*Primary Examiner* — Michael Lebentritt
(74) *Attorney, Agent, or Firm* — Helene Raybaud

(57) ABSTRACT

An impeller blade that includes an impeller blade body constructed of a first material. The impeller blade body defines a leading edge that faces a direction of rotation. A second material couples to the leading edge. The second material is a more erosion resistant material than the first material. The second material extends over the leading edge a distance to absorb high angle impacts of droplets and/or particulate. A third material couples to at least a portion of the impeller blade body.

19 Claims, 9 Drawing Sheets

(56) References Cited

U.S. PATENT DOCUMENTS 6,440,575 B1 * 8/2002 Heimberg ..... C23C 28/00 428/469
6,517,959 B1 * 2/2003 Beele ..... C23C 8/02 427/419.1
6,528,189 B1 * 3/2003 Beele ..... C23C 28/00 416/241 B
6,649,682 B1 11/2003 Breton et al.
6,733,907 B2 * 5/2004 Morrison ..... B32B 18/00 428/699
6,764,771 B1 * 7/2004 Heimberg ..... C23C 30/00 428/472
7,186,092 B2 3/2007 Bruce et al.
9,476,427 B2 10/2016 Torkildsen et al.
2005/0079368 A1 * 4/2005 Gorman ..... C23C 4/02 428/469
2005/0255329 A1 * 11/2005 Hazel ..... C23C 14/0617 428/472
2008/0081214 A1 * 4/2008 Narita ..... C22C 27/00 428/665
2009/0011195 A1 * 1/2009 Bruce ..... C23C 14/0641 428/174
2009/0297720 A1 * 12/2009 Ramgopal ..... C23C 4/06 427/455
2010/0143108 A1 * 6/2010 Uihlein ..... F01D 5/288 415/200
2010/0247321 A1 * 9/2010 Kulkarni ..... C23C 28/347 416/223 R
2010/0304084 A1 * 12/2010 Anand ..... B32B 15/01 428/141
2010/0304107 A1 * 12/2010 Nardi ..... C23C 4/12 428/217
2010/0304181 A1 * 12/2010 Anand ..... C23C 4/12 428/627
2011/0116906 A1 * 5/2011 Smith ..... B64C 11/205 415/1
2011/0165433 A1 * 7/2011 Pabla ..... C23C 18/1651 428/615
2013/0199934 A1 * 8/2013 Parkos, Jr. ..... C25D 1/02 205/50
2014/0272166 A1 9/2014 Shim et al.
2016/0108509 A1 * 4/2016 Anand ..... B22F 3/10 204/196.23
2017/0022994 A1 1/2017 Torkildsen
2018/0223875 A1 8/2018 Torkildsen
2019/0284686 A1 * 9/2019 Melnik ..... F01D 9/02

* cited by examiner

EROSION RESISTANT BLADES FOR COMPRESSORS

CROSS-REFERENCE TO RELATED APPLICATION

This application claims priority from and the benefit of U.S. Provisional Application Ser. No. 62/572,978, entitled "EROSION RESISTANT IMPELLERS FOR WET GAS COMPRESSORS", filed Oct. 16, 2017, which is herein incorporated by reference in its entirety for all purposes.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it may be understood that these statements are to read in this light, and not as admissions of prior art.

Wells are drilled to extract oil and/or gas from subterranean reserves. These resources are extracted from the well bore through a wellhead that couples to the end of the wellbore. The flow of oil and/or gas out of the well is typically controlled by one or more valves on the wellhead. After flowing through the wellhead, the flow of oil and/or gas may be directed to a compressor that pumps the oil and/or gas to the surface, in a subsea environment, and/or pumps the fluid flow to another location, such as a refinery. Unfortunately, as oil and/or gas flow out of the well they may carry particulate, such as sand and/or rock. Over time, this particulate may wear the blades on the compressor, which may result in reduced performance of the compressor and increased maintenance of the compressor.

BRIEF SUMMARY

In one embodiment, a compressor that includes a first impeller section that rotates in a first direction and a second impeller section that rotates in a second direction that is opposite the first direction. The first and second impeller sections are axially aligned. The first impeller section and the second impeller section include an impeller blade with an impeller blade body constructed of a first material. The impeller blade body defines a leading edge that faces a respective direction of rotation. A second material couples to the leading edge. The second material includes a material that is more erosion resistant than the first material. The second material extends over the leading edge a distance to absorb high angle impacts of droplets and/or particulate.

In another embodiment, a method for manufacturing an erosion resistant impeller blade. The method includes obtaining a first material for an impeller blade body. The method also includes machining the first material to form the impeller blade body. The method continues by coupling a second material to a leading edge of the impeller blade body. The second material is more erosion resistant than the first material. The second material is configured to extend over the leading edge a distance to absorb high angle impacts of droplets and/or particulate.

In another embodiment, an impeller blade that includes an impeller blade body constructed of a first material. The impeller blade body defines a leading edge that faces a direction of rotation. A second material couples to the leading edge. The second material includes a material that is more erosion resistant than the first material. The second material extends over the leading edge a distance to absorb high angle impacts of droplets and/or particulate. A third material couples to at least a portion of the impeller blade body.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
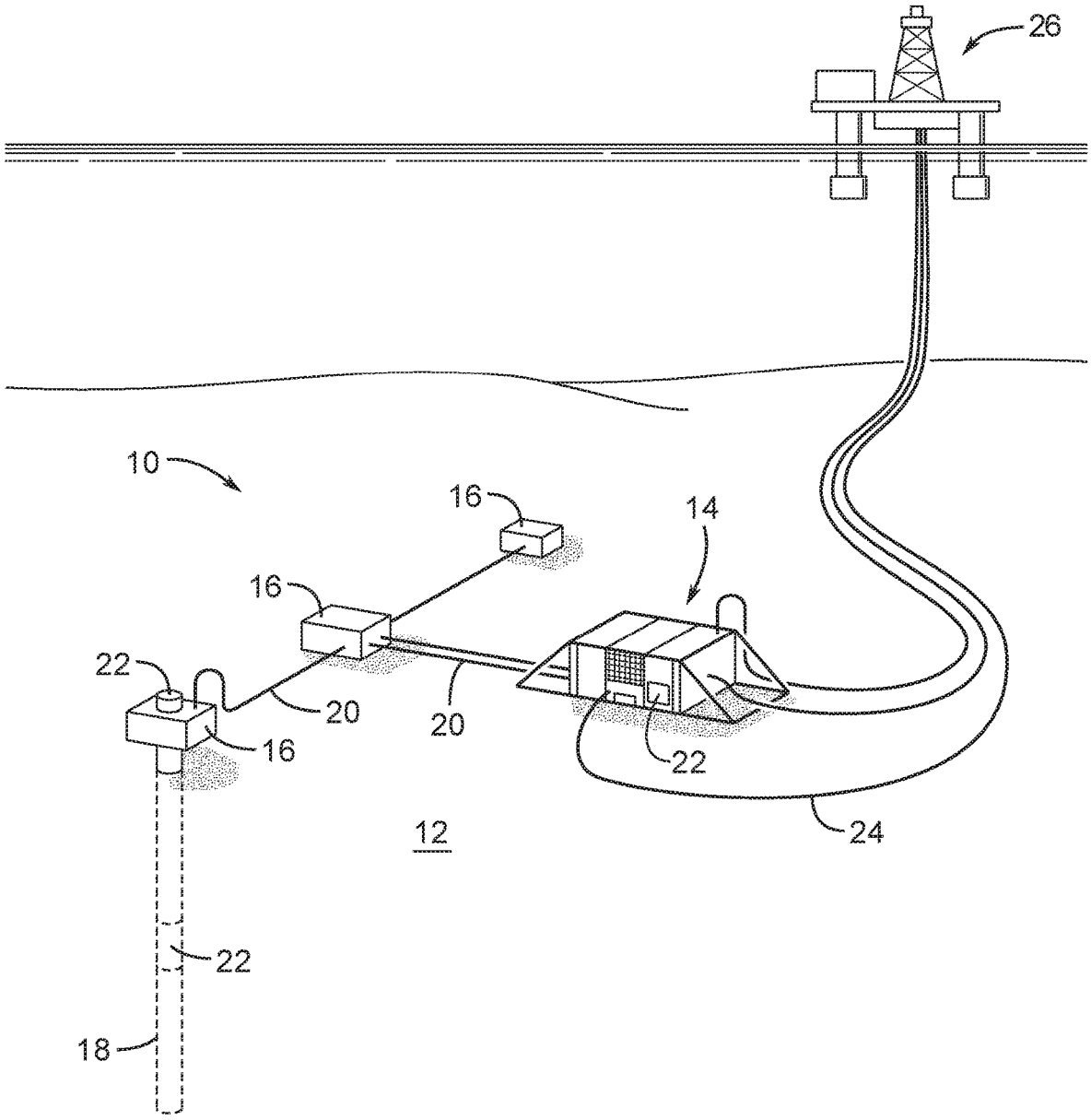
FIG. 1 is a schematic illustration of a mineral extraction system with a wet gas compressor, according to an embodiment of the disclosure.

Reference will now be made in detail to specific embodiments illustrated in the accompanying drawings and figures. In the following detailed description, numerous specific details are set forth in order to provide a thorough understanding of the invention. However, it will be apparent to one of ordinary skill in the art that embodiments may be practiced without these specific details. In other instances, well-known methods, procedures, components, have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object, and, similarly, a second object could be termed a first object, without departing from the scope of the present disclosure.

The terminology used herein is for the purpose of describing particular embodiments only and is not intended to be limiting. As used in the description and the appended claims, the singular forms "a," "an" and "the" are intended to include the plural forms as well, unless the context clearly indicates otherwise. It will also be understood that the term "and/or" as used herein refers to and encompasses any and possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, operations, elements, components, and/or groups thereof. Further, as used herein, the term "if" may be construed to mean "when" or "upon" or "in response to determining" or "in response to detecting," depending on the context.

The present disclosure relates to compressors, such as contra-rotating wet gas compressors. Contra-rotating wet gas compressors include inner and outer impeller sections that couple to separate shafts that rotate in opposite directions. The impeller sections are arranged so that alternating impeller sections rotate in opposite directions. This may enable the compressor to operate without static diffusers between the rotating impeller sections. Each impeller section includes impeller blades that rotate with the impeller sections. As the impeller blades rotate they transfer mechanical energy to the fluid (e.g., oil and/or gas), which compresses and drives the fluid through the contra-rotating wet gas compressor.

The impeller sections discussed below include erosion resistant blades. These erosion resistant blades are formed from multiple materials. These materials may be located at different positions on the blades enabling the blades to resist erosion from different types of particulate impact. More specifically, the different materials may reduce erosion from particulate impact at different angles relative to the blade.

FIG. 1 is a schematic of a mineral extraction system 10 in a subsea environment. In some embodiments, to extract oil and/or natural gas from the sea floor 12, the mineral extraction system 10 may include a subsea station 14. The subsea station 14 is positioned downstream from one or more wellheads 16 that couple to wells 18. After drilling the wells 18, hydrocarbons (e.g., oil, gas) flow through the wells 18 to the wellheads 16. The hydrocarbons then flow from the wellheads 16 through jumper cables 20 to the subsea station 14. The subsea station 14 includes a compressor module 22, which may be powered by an electric motor, such as an induction motor or permanent magnet motor. The compressor module 22 may include one or more contra-rotating wet gas compressors (e.g., surge free contra rotating wet gas compressor) that pump oil and/or natural gas flowing out of the wells 18.

The subsea station 14 is connected to one or more flow lines, such as flow line 24. As illustrated, the flow line 24 couples to a platform 26, enabling oil and/or gas to flow from the wells 18 to the platform 26. In some embodiments, the flow lines 24 may extend from the subsea station 14 to another facility such as a floating production, storage and offloading unit (FPSO), or a shore-based facility. The flow lines 24 can also be used to supply fluids, as well as include control and data lines for use with the subsea equipment. In operation, the compressor module 22 pumps oil and/or natural gas from the subsea station 14 to the platform 26 through the flow line 24. In some embodiments, the compressor module 22 may also be located downhole, or in a subsea location such as on the sea floor in a Christmas tree at a wellhead 16.

It should be understood that the compressor module 22 may be configured for other subsea fluid processing functions, such as a subsea pumping module, a seawater injection module, and/or a subsea separator module. It should also be understood that the compressor module 22 may pump single-phase liquids, single-phase gases, or multiphase fluids.

Figure 2:
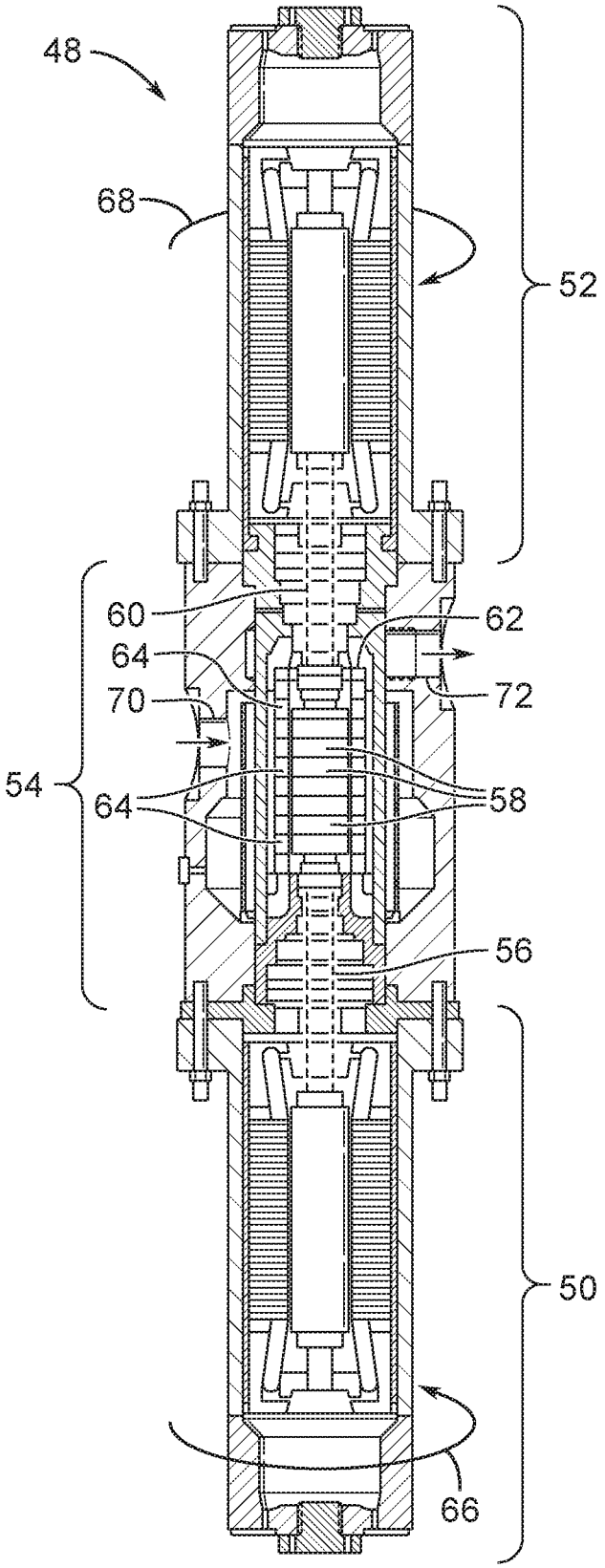
FIG. 2 is a cross-sectional view of a wet gas compressor, according to an embodiment of the disclosure.

FIG. 2 is a cross-sectional view showing further details of a contra-rotating wet gas compressor 48 of the compressor module 22. The contra-rotating wet gas compressor 48 includes a first motor 50, a second motor 52, and a contra-rotating compressor section 54. In operation, the first motor 50 drives a shaft 56 that rotates a plurality of inner impeller sections 58 within the compressor section 54. Similarly, the second motor 52 drives a shaft 60 that rotates an outer sleeve 62 within the compressor section 54. The outer sleeve 62 couples to and rotates a plurality of outer impeller sections 64. In operation, the first motor 50 rotates the inner impeller sections 58 in a first direction, while the second motor 52 rotates the outer impeller sections 64 in a second direction. For example, the first motor 50 may rotate the inner impeller sections 58 in counterclockwise direction 66, while the second motor 52 rotates the outer impeller sections 64 in clockwise direction 68. It should be understood that the rotational directions of the inner impeller sections 58 and the outer impeller section 64 may be switched depending on the embodiment. As the inner impeller sections 58 and the outer impeller section 64 rotate in opposite directions fluid is pumped through the contra-rotating wet gas compressor 48 from an inlet 70 to an outlet 72, enabling the contra-rotating wet gas compressor 48 two pump multiphase fluids without stationary impellers to control and drive fluid flow.

Figure 3:
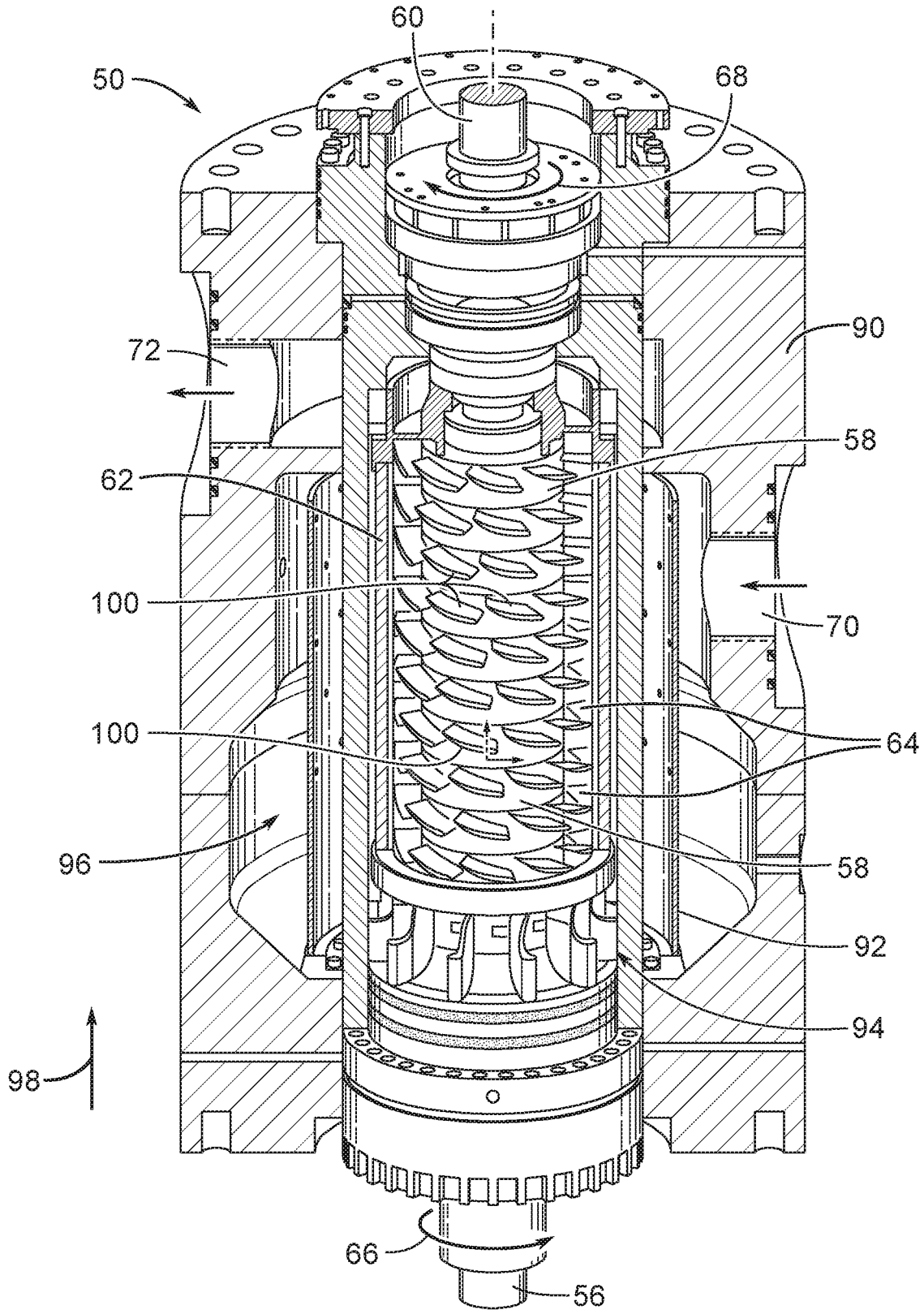
FIG. 3 is a partial cross-sectional view of a counter rotating compressor section of a wet gas compressor, according to an embodiment of the disclosure.
Figure 4:
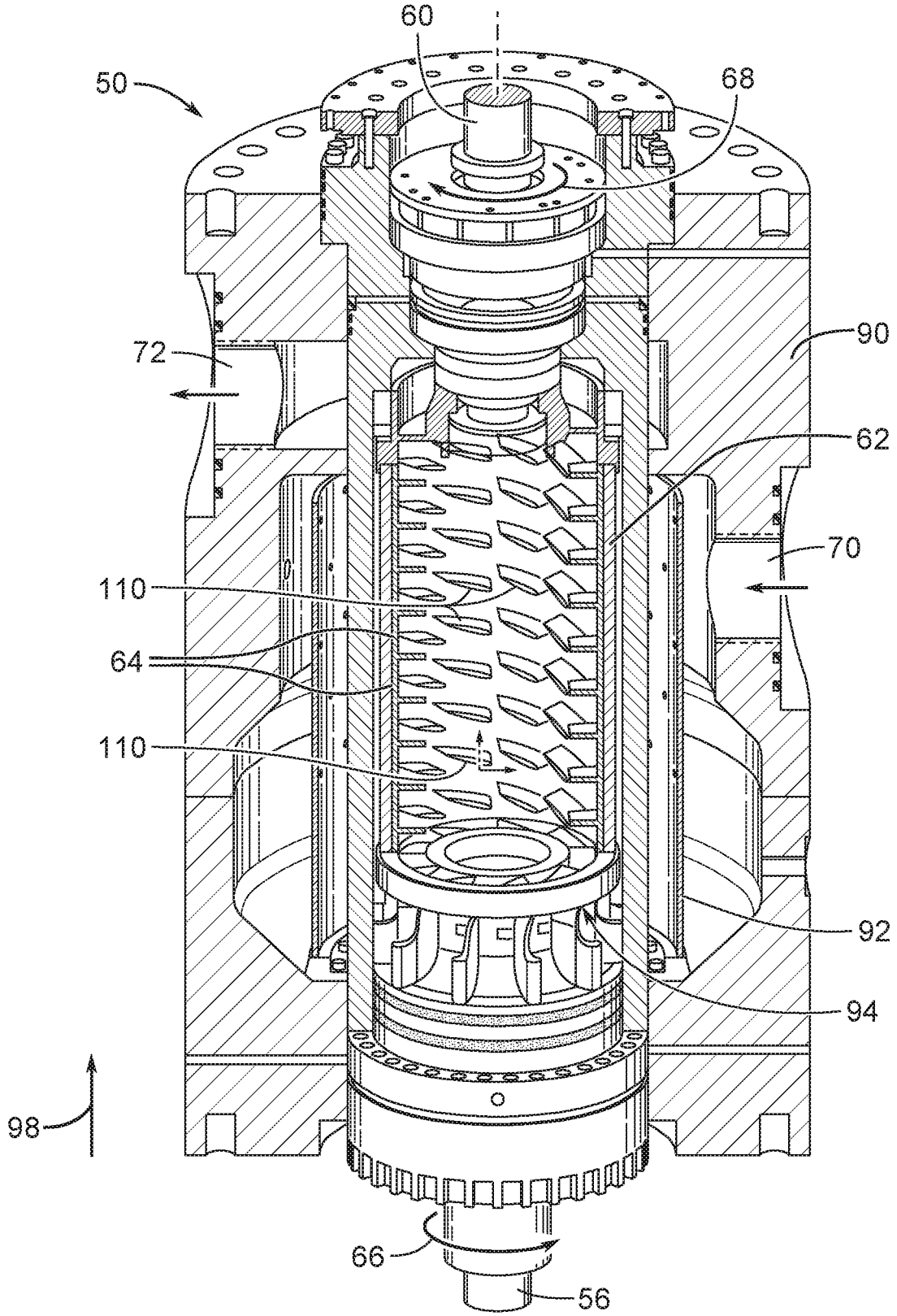
FIG. 4 is a partial cross-sectional view of a counter rotating compressor section of a wet gas compressor, according to an embodiment of the disclosure.

FIGS. 3 and 4 are partial cross-sectional views of the compressor section 54 of the contra-rotating wet gas compressor 48. As illustrated, fluid (e.g., mixture of fluids) enters the compressor section 54 via the inlet 70 in the housing 90. The fluid then passes around and/or through a perforated wall 92 and through a manifold 94 where it enters an impeller unit 96 from the bottom in direction 98. The impeller unit 96 includes the alternating rows of inner impeller sections 58 and outer impeller sections 64. In operation, the inner impeller sections 58 and outer impeller section 64 are driven/rotate in opposite directions to drive the fluid in direction 98. As the fluid progresses through the alternating rows of inner impeller section 58 and outer impeller section 64, in direction 98, the fluid is compressed to increasingly higher pressures. In other words, because the inner impeller sections 58 and the outer impeller sections 64 are alternatingly stacked and rotate in opposite directions, each inner impeller section 58 and outer impeller section 64 effectively forms a separate stage of the impeller unit 96. After passing through these stages of inner impeller sections 58 and outer impeller sections 64, the compressed fluid is directed through an outlet 72 in the housing 90. The fluid may then enter flow line 24 for transmission.

As explained above, the shaft 56 couples to the plurality of inner impeller sections 58 within the compressor section 54. As the shaft 56 rotates in counterclockwise direction 66, the shaft 56 rotates the inner impeller section 58 in counterclockwise direction 66. The rotation of the inner impeller section 58 rotates a plurality of impeller blades/airfoils 100 coupled to each inner impeller section 58. It is these impeller blades/airfoils 100 that drive and compress the fluid. Unfortunately, as the impeller blades 100 rotate they may contact particulate carried by the fluid. The particulate may include sand, rock, and other hard materials that may contact the impeller blades 100 at high speeds. More specifically, because the inner impeller sections 58 rotate in a first direction and the outer impeller sections 64 rotate in a second direction opposite the first direction, the relative speed between the inner impeller sections 58 and outer impeller sections 64 increases. For example, if the inner impeller sections 58 are rotating at 50 m/s and the outer impeller sections 64 are rotating at 50 m/s the relative difference in speed between the inner impeller sections 58 and the outer impeller sections 64 is 100 m/s. Accordingly, particulate may contact the impeller blades 100 at high speeds as it is alternatingly driven from inner impeller sections 58 to the outer impeller sections 64. To reduce the wear on these impeller blades 100 and thus increase the longevity of the contra-rotating wet gas compressor 48, the impeller blades 100 may be coated and/or formed out of multiple materials placed at specific locations to reduce erosion caused by particulate striking the impeller blades 100.

FIG. 4 illustrates a partial cross-sectional view of the compressor section 54 with the inner impeller sections 58 removed. As explained above, the second motor 52 rotates the shaft 60. For example, the second motor 52 may rotate the shaft 60 in a clockwise direction 68. As the shaft 60 rotates, it rotates outer sleeve 62. The outer sleeve 62 couples to the outer impeller sections 64 and therefore rotates the outer impeller sections 64 in clockwise direction 68. As illustrated, each of the outer impeller hub section 64 includes a plurality of impeller blades/airfoils 110. As the impeller blades 110 rotate, they may contact particulate carried by the fluid. The particulate may include sand, rock, and other hard materials that may contact the impeller blades 110 at high speeds. To reduce the wear on these impeller blades 110 and thus increase the longevity of the contra-rotating wet gas compressor 48, the impeller blades 110 may be coated and/or formed out of multiple materials placed at specific locations to reduce erosion caused by particulate striking the impeller blades 110.

Figure 5:
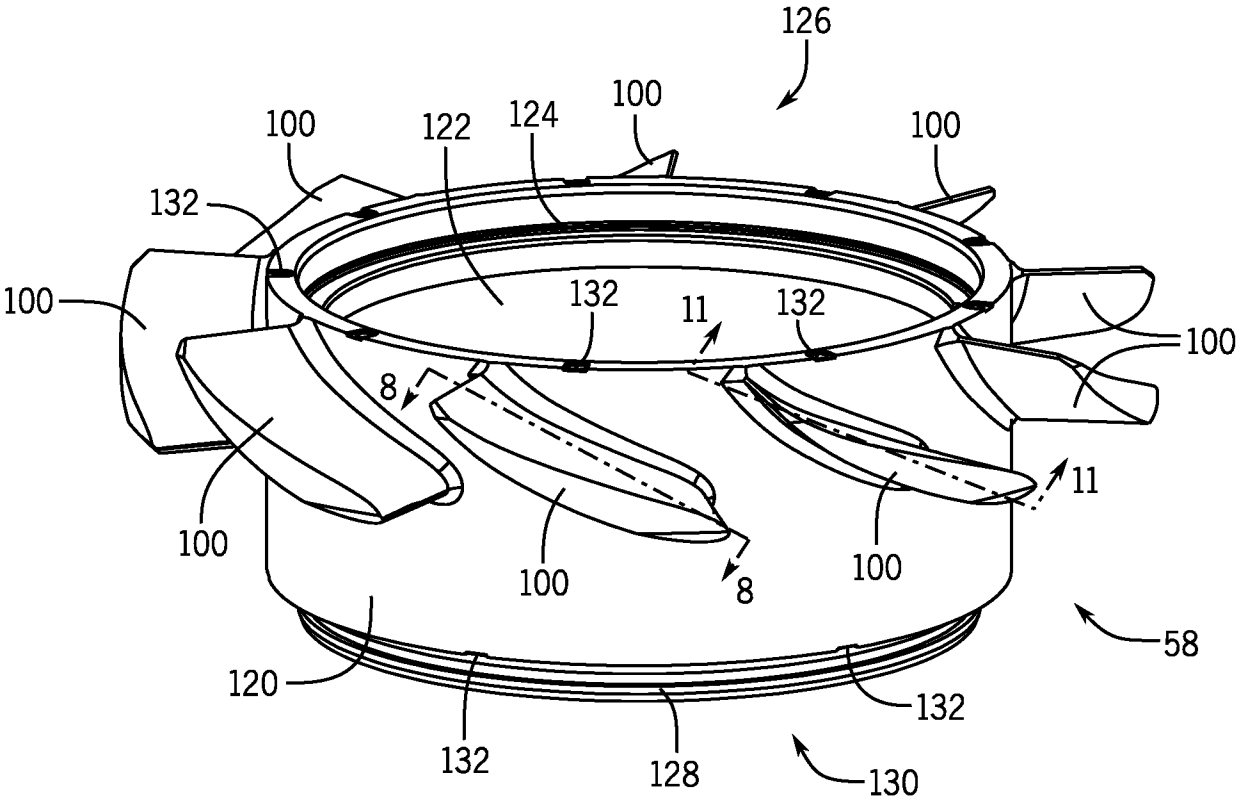
FIG. 5 is a perspective view of an inner impeller section, according to an embodiment of the disclosure.

FIG. 5 is a perspective view of an inner impeller section 58. As illustrated, the inner impeller section 58 includes a hub 120 with a plurality of impeller blades/airfoils 100 (e.g., 1, 2, 3, 4, 5, 6, 7, 8, 9, 10, or more). The impeller blades 100 may be integrally formed with the hub 120 (e.g., formed from one-piece) or may be separately coupled to the hub 120. For example, the impeller blades 100 may be brazed and/or welded to the hub 120, or connected through a dovetail joint or similar. The hub 120 defines an aperture 122 that enables the inner impeller section 58 to receive the shaft 56 illustrated in FIGS. 3 and 4 and described above. In order to couple neighboring inner impeller sections 58 together, the hub 120 defines a counterbore 124 at a first end 126 and a circumferential groove 128 at a second end 130. That is, the second end 130 with the circumferential groove 128 may be inserted into a counterbore 124 of a hub 120 of a neighboring inner impeller section 58. In this way, the inner impeller sections 58 may be stacked one on top of the other. In order to block rotation of the inner impeller sections 58 relative to each other, the first end 126 and second end 130 may define a plurality of apertures 132 spaced about the circumference of the hub 120. These apertures 132 may receive pins that couple neighboring inner impeller sections 58 together, facilitate alignment of neighboring inner impeller sections 58 to each other, as well as block rotation of the inner impeller sections 58 relative to each other. That is, pins placed in the apertures 132 on the first end 126 will also extend into apertures 132 on the second end 130 of a neighboring inner impeller section 58.

Figure 6:
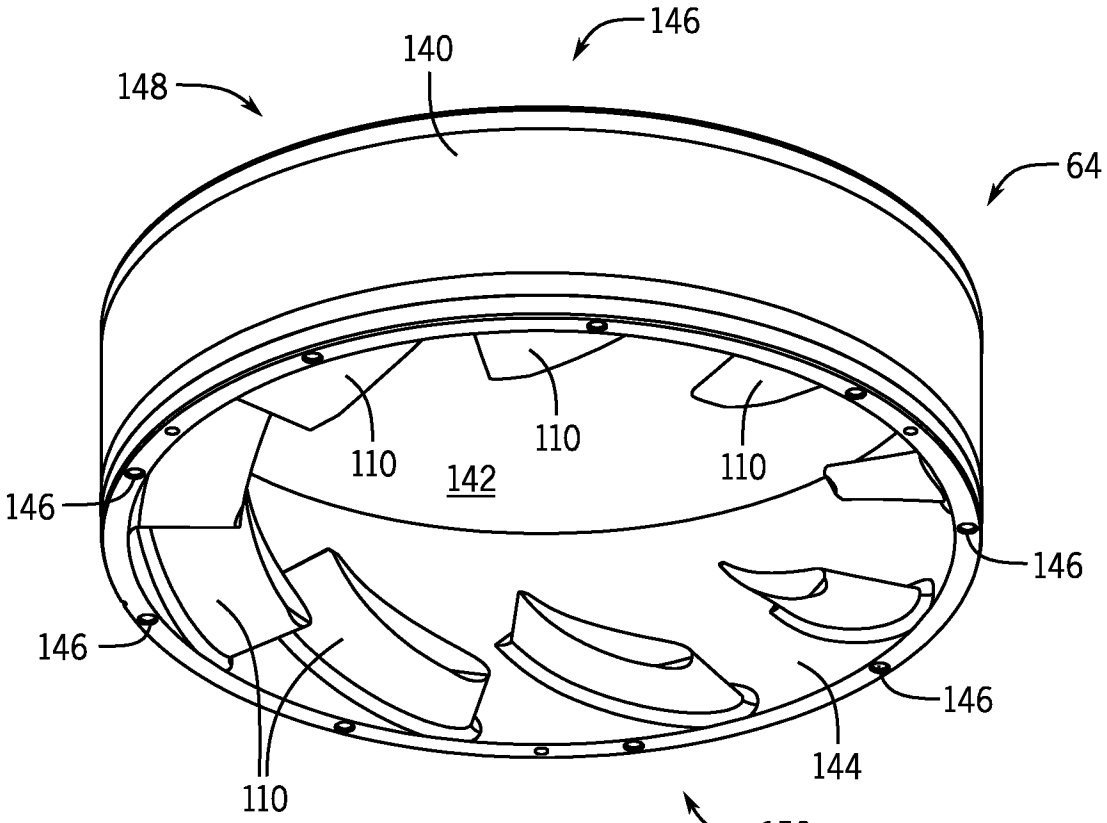
FIG. 6 is a perspective view of an outer impeller section, according to an embodiment of the disclosure.

FIG. 6 is a perspective view of an outer impeller section 64. As illustrated, the outer impeller section 64 includes a hub 140 that defines an aperture 142. It is within this aperture 142 along the inner circumferential surface 144 that the outer impeller section 64 includes a plurality of impeller blades/airfoils 110 (e.g., 1, 2, 3, 4, 5, 6, 7, 8, 9, 10, or more). These impeller blades 110 may be integrally formed with the hub 140 (e.g., made out of one-piece) or may be separately coupled to the hub 140. For example, the impeller blades 110 may be brazed and/or welded to the hub 140, or connected through a dovetail joint or similar.

In order to couple neighboring outer impeller sections 64 together, the hub 140 defines a plurality of apertures 146 on both the first end 148 and the second end 150. These apertures 146 may receive pins that couple neighboring outer impellers sections 64 together, facilitate alignment of neighboring outer impeller sections 64 to each other, as well as block rotation of the outer impeller sections 64 relative to each other. That is, pins in the apertures 146 on the first end 148 will extend into apertures 146 on the second end 150 of a neighboring outer impeller section 64.

Figure 7:
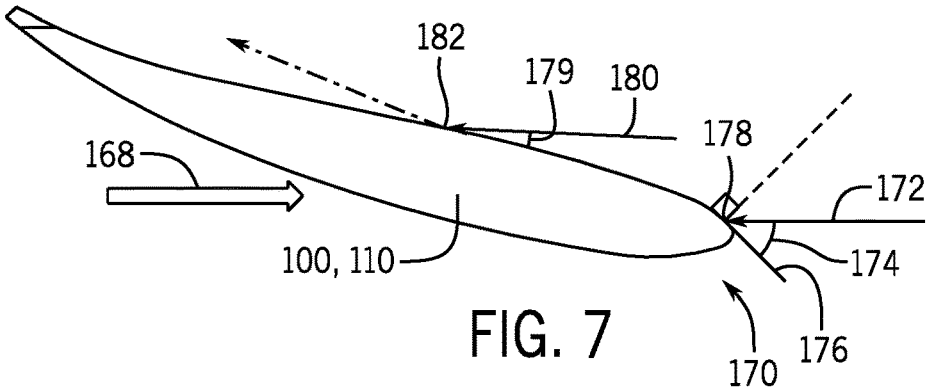
FIG. 7 is a side view of an impeller blade, according to an embodiment of the disclosure.

FIG. 7 is a side view of an impeller blade 100, 110. As explained above, impeller blades 100, 110 rotate with the respective inner impeller sections 58 or the outer impeller sections 64. As the impeller blades 100, 110 rotate (e.g., move in direction 168) about the central axis of the inner and outer impeller sections 58, 64, they drive and compress the fluid in the compressor section 54. Furthermore, as the impeller blades 100, 110 spin in the presence of liquid and solids, the leading edge 170 of each impeller blade 100, 110 may be exposed to impacts from liquid droplets and/or solid particles in the fluid. These impacts on the leading edge 170 are high angle impacts, meaning that the velocity vector of the droplet or particle is oriented at a high angle relative to a tangential impact surface of the impeller blade 100, 110. For example, a velocity vector 172 of a particle (e.g., liquid droplet, solid particle) is shown in FIG. 7. The impact angle 174 is measured between the velocity vector 172 and the tangent 176 of the impact surface location 178. A high impact angle 174 includes angles between 45° and 90°. Impacts at high angles on the impeller blade 100, 110 may rapidly wear the leading edge 170 because the particulate and/or droplet does not glance off the impeller blade 100, 110. In other words, a droplet and/or a particulate strikes the impeller blade 100, 110 with greater force. In contrast, a low impact angle 179 formed by the velocity vector 180 with a tangent to the impact surface location 182 reduces the force of the droplet and/or particulate when striking the impeller blade 100, 110. A low impact angle 179 includes angles between 0° and 45°.

Particle and/or droplet impacts at both high and low angles may cause erosion of the material of the impeller blades 100 and 110. The erosion may depend on the mass of the particulate impacting a surface, and on the velocity of the impinging particles. The dependence on the impact angle of the impinging articles is more complex, and varies between different materials. Accordingly, different materials may erode at different rates depending also on the angle of each impact.

In general, hard and dense materials, such as tungsten carbide and diamond, resist erosion better than softer and less dense materials, such as metals or plastics. It could thus be desirable to manufacture the impellers from a dense and hard material, like tungsten carbide. Other materials used to manufacture the impeller blades 100, 110 may include engineering ceramics such as silicon nitride, silicon carbide, boron carbide, aluminum oxide, and zirconia, or polycrystalline diamond. Such materials generally do not have desirable mechanical properties for mechanical parts exposed to high stress levels, such as the impellers blades 100, 110. For example, hard and dense materials tend to be brittle, meaning that they have relatively low tensile yield strength, and that fracture propagation may happen rapidly and cause failures. The impeller blades 100, 110 of the present disclosure may include two or more different materials with different properties to increase erosion resistance. These materials may be placed at different locations on the impeller blades 100, 110 to increase erosion resistance from low and high angle impacts of particulate and/or droplets.

Figure 8:
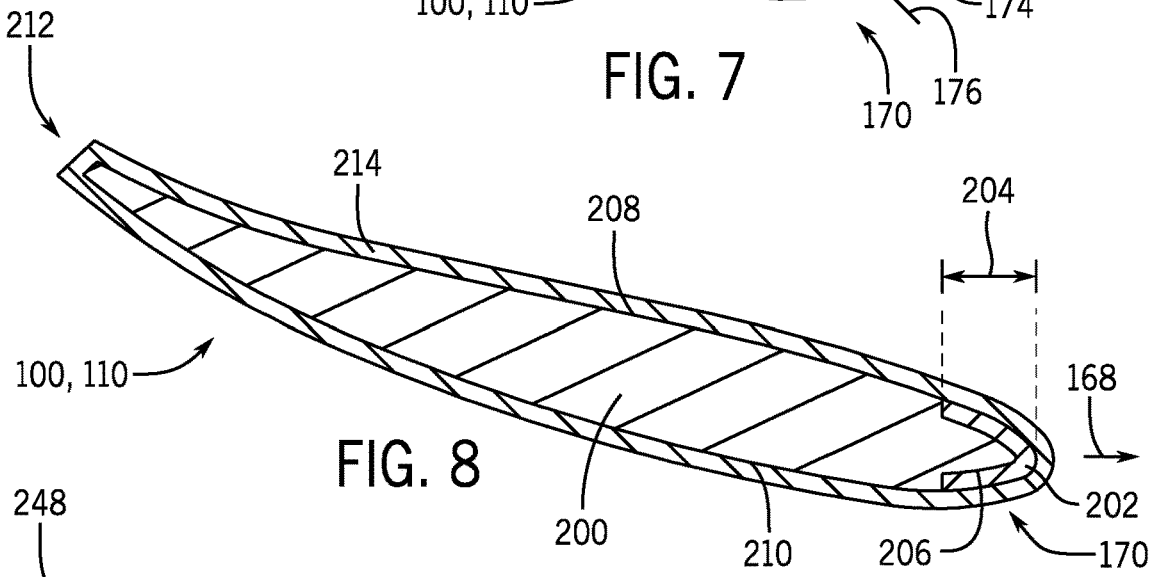
FIG. 8 is a cross-sectional side view of an impeller blade along line 8-8 of FIG. 5, according to an embodiment of the disclosure.

FIG. 8 is a cross-sectional view of an impeller blade along line 8-8 of FIG. 5. The core/body 200 of the impeller blade 100, 110 is made from a strong and tough material (e.g., a high-strength steel, nickel-based super alloy, or or a titanium alloy). It is complemented by a coating or insert 202 on the leading edge 170. The first coating or insert 202 is made from a hard and dense material that resists impacts at high angles. Indeed, the coating or insert 202 extends a distance 204 (e.g., a few millimeters to several centimeters) along the length of the impeller blade 100, 110 so that droplets and/or particulate striking the impeller blade 100, 110 at high impact angles primarily contact the coating or insert 202 as the impeller blade 100, 110 rotates in direction 168 (e.g., circumferential direction 66 or 68) about the central axis of the inner and/or outer impeller sections 58, 64. As explained above, a high impact angle typically refers to an angle between 45° and 90° formed by the velocity vector of the droplet or particle and a tangent of the impact surface/point.

As illustrated, impeller blade 100, 110 may define a groove 206 that extends over the leading edge 170 to accommodate the coating or insert 202 and to enable the coating or insert 202 to match the profile of the impeller blade 100, 110. The coating 202 may for example be attached to the impeller blade 100, 110 over this groove 206 using high velocity oxygen fuel (HVOF), high velocity air fuel (HVAF), or D-Gun thermal spray, plasma spray, laser cladding, and Conforma Clad brazing. Many other application techniques are available. The coating 202 may for example be made from tungsten carbide, tungsten carbide-metal composite, polycrystalline diamond, or other ceramics or ceramic-metal composites. In some embodiments, if the coating 202 includes tungsten carbide the thickness of the coating 202 may be greater than 0.1 mm and less than 3 mm. A thickness greater than 3 mm may reduce the strength of the tungsten carbide coating.

In some embodiments, the coating 202 may be in form of an insert. The insert may be coupled to the impeller blade 100, 110 by brazing, gluing, welding, and/or a mechanical joint, e.g. a dovetail joint. The insert may be made from tungsten carbide, polycrystalline diamond, a metal ceramic composite, silicon nitride, silicon carbide, boron carbide, aluminum oxide, zirconia, or another ceramic.

Other surfaces of the impeller blade 100, 110 may be exposed to droplet and particle impacts at lower angles, as explained above. The surfaces may include the upper surface 208 and the lower surface 210 (e.g., side surfaces), as well as the trailing edge 212, while hard and dense materials such as tungsten carbide resist erosion caused by low angle impacts as well and may be applied to the entire impeller blade surface. This may be expensive and complicated. Furthermore, impeller blades generally call for accurate tolerances on the geometry of the impeller surface. Poor tolerances or rough surfaces may have a negative effect on the performance of the impeller, and may cause mechanical interference between parts. The geometrical accuracy and finish of the coated surfaces may be improved after application by machining, polishing or grinding, but this is also expensive and complicated, and may be time consuming.

Accordingly, a second coating 214 may be applied to the other surfaces that encounter low-angle impacts. For example, sprayed or vapor-deposited coatings may be used. Vapor deposited coatings may be applied to large surfaces in one operation, and the resulting second coating 214 is largely uniform with a smooth surface finish. The second coating 214 may therefore not need polishing or grinding down after application. Other application methods to apply the second coating 214 may also be used, such as thermal spray methods or plasma spray methods.

In one embodiment, the second coating 214 may be titanium aluminum nitride. This coating may be applied through the physical vapor deposition method. The second coating 214 may be uniformly deposited and/or applied to the leading edge 170, upper surface 208, lower surface 210, trailing edge 212, and/or the tip. The thickness of second coating 214 may be between 0.001 mm and 0.5 mm. The coating 214 may extend over the coating 202 on the leading edge 170 or may not be applied over the coating on the leading edge 170.

Figure 9:
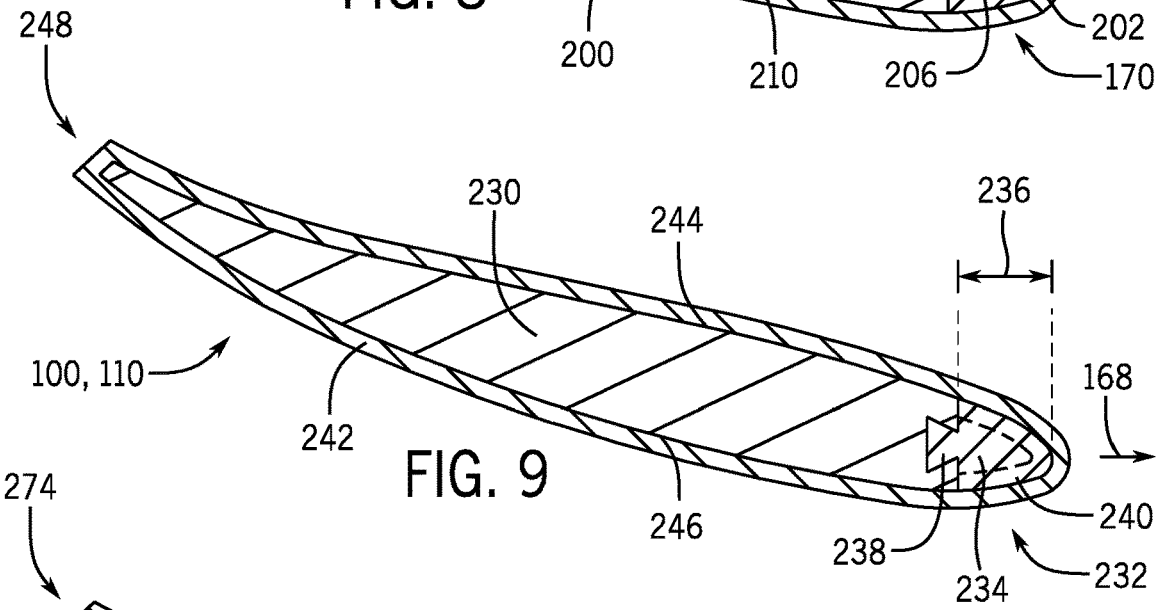
FIG. 9 is a cross-sectional side view of an impeller blade along line 8-8 of FIG. 5, according to an embodiment of the disclosure.

FIG. 9 is a cross-sectional view of an impeller blade 100, 110 along line 8-8 of FIG. 5. As explained above, a core/body 230 of the impeller blade 100, 110 is made from a strong and tough material (e.g., a high-strength steel, nickel-based super alloy, or a titanium alloy). Unfortunately, the impact of droplets and/or particulate at high angles on the leading edge 232 may erode the material of the core 230 impeller blade 100, 110. Accordingly, the impeller blade 100, 110 may include an insert 234 that couples to the core 230. The insert 234 may resist erosion from droplets and/or particulate that strikes against the leading edge 232 at high angles. The insert 234 extends a distance 236 (e.g., a few mm to several cm) from the end of the core 230 so that droplets and/or particulate striking the impeller blade 100, 110 at high impact angles primarily contact the insert 234 as the impeller blade 100, 110 rotates in direction 168 (e.g., circumferential direction 66 or 68) about the central axis of the inner and/or outer impeller sections 58, 64.

As explained above, a high impact angle may refer to an angle between 45° and 90° formed by the velocity vector of the droplet or particle and a tangent of the impact surface point. The insert 234 may be coupled to the impeller blade 100, 110 via a joint, such as a dovetail joint, or another joining method, e.g. gluing, brazing, or a fastener. The insert 234 may be made from tungsten carbide, polycrystalline diamond, a metal ceramic composite, silicon nitride, silicon carbide, boron carbide, aluminum oxide, zirconia, or another ceramic. In some embodiments, insert 234 may include an insert body 238 and a coating 240 coupled to the insert body 238. The coating 240 may include tungsten carbide, polycrystalline diamond, engineering ceramics, or ceramic-metal composites. In some embodiments, if the coating 240 includes tungsten carbide the thickness of the coating 240 may be greater than 0.1 mm and less than 3 mm. A thickness greater than 3 mm may reduce the strength of the tungsten carbide coating. As explained above, a coating 242 may be applied to the other surfaces that encounter low-angle impacts. These surfaces include an upper or first side surface 244, a lower or second side surface 246, trailing edge 248, and/or the tip. For example, the coating 242 may be a vapor-deposited coating of titanium aluminum nitride. In other embodiments, the coating 242 may be titanium nitride, chromium nitride, chromium aluminium titanium nitride, a diamond like coating, or multiple layers of various of these and other coatings. The thickness of coating 242 may be between 0.001 mm and 0.5 mm. The coating 242 may extend over the insert 234 or may not be applied over the insert 234 on the leading edge 232.

Figure 10:
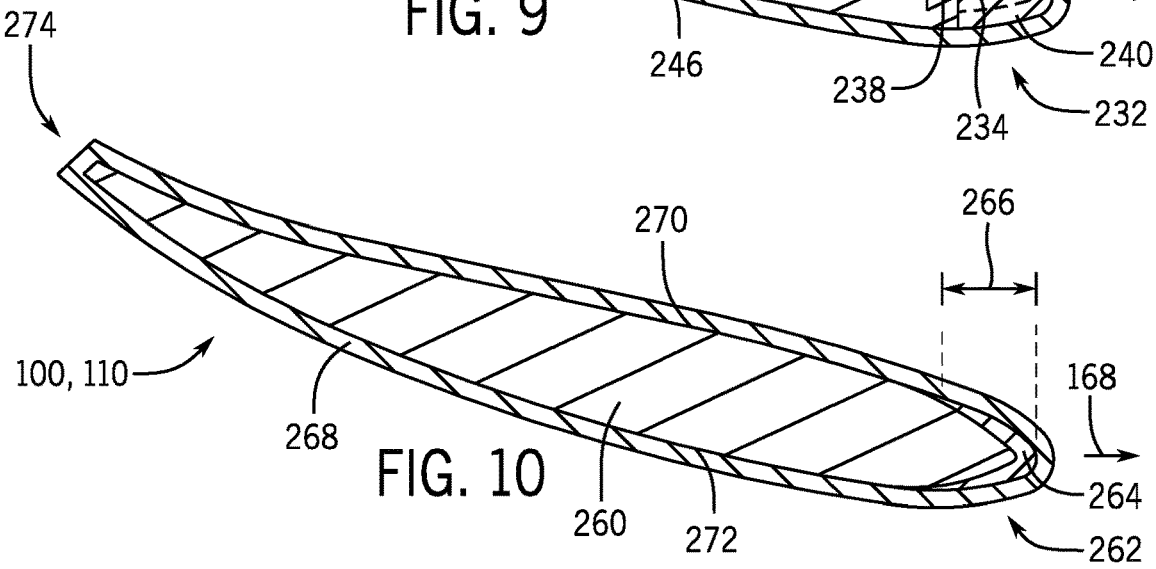
FIG. 10 is a cross-sectional side view of an impeller blade along line 8-8 of FIG. 5, according to an embodiment of the disclosure.

FIG. 10 is a cross-sectional view of an impeller blade 100, 110 along line 8-8 of FIG. 5. A core/body 260 of the impeller blade 100, 110 is made from a strong and tough material (e.g., a high-strength steel, nickel-based super alloy, or a titanium alloy. Unfortunately, the impact of droplets and/or particulate at high angles on the leading edge 262 may erode the material of the core 260. Accordingly, the impeller blade 100, 110 may include an insert or coating 264 that couples to the core 260. The insert or coating 264 may resist erosion from droplets and/or particulate that strikes against the leading edge 262 at high angles. The insert or coating 264 extends a distance 266 (e.g., a few mm to several cm) so that droplets and/or particulate striking the impeller blade 100, 110 at high impact angles primarily contact the insert or coating 264 as the impeller blade 100, 110 moves in direction 168 (e.g., circumferential direction 66 or 68) about the central axis of the inner and/or outer impeller sections 58, 64. As explained above, a high impact angle may refer to an angle between 45° and 90° formed by the velocity vector of the droplet or particle and a tangent of the impact surface point.

As illustrated, impeller blade 100, 110 may not include a groove; instead, the insert or coating 264 may taper in thickness as it extends over the leading edge 262. The coating 264 may be attached to the impeller blade 100, 110 using high velocity oxygen fuel (HVOF), high velocity air fuel (HVAF) and D-Gun thermal spray, plasma Spray, laser cladding, and Conforma Clad brazing. The coating 264 may be made from tungsten carbide, tungsten carbide-metal composite, polycrystalline diamond, or other ceramics or ceramic-metal composites. If the coating 264 is in the form of an insert, the insert may be coupled to the impeller blade 100, 110 by brazing, gluing, welding, or mechanical joining, e.g. a dovetail joint. The insert may be made from tungsten carbide, polycrystalline diamond, a metal ceramic composite, silicon nitride, silicon carbide, boron carbide, aluminum oxide, zirconia, or another ceramic.

In some embodiments, if the coating 264 includes tungsten carbide the thickness of the coating 264 may be greater than 0.1 mm and less than 3 mm. A thickness greater than 3 mm may reduce the strength of the tungsten carbide coating. As explained above, a second coating 268 may be applied to other surfaces of the impeller blade 100, 110 that receive low-angle impacts. These surfaces include an upper or first side surface 270, a lower or second side surface 272, trailing edge 274, and/or the tip. For example, the coating 268 may be a vapor-deposited coating of titanium aluminum nitride. In other embodiments, the coating 268 may be titanium nitride, chromium nitride, chromium aluminium titanium nitride, a diamond like coating, or multiple layers of various of these and other coatings. The coating 268 may extend over the coating 264 on the leading edge 262 or may not be applied over the coating 264 on the leading edge 262.

Figure 11:
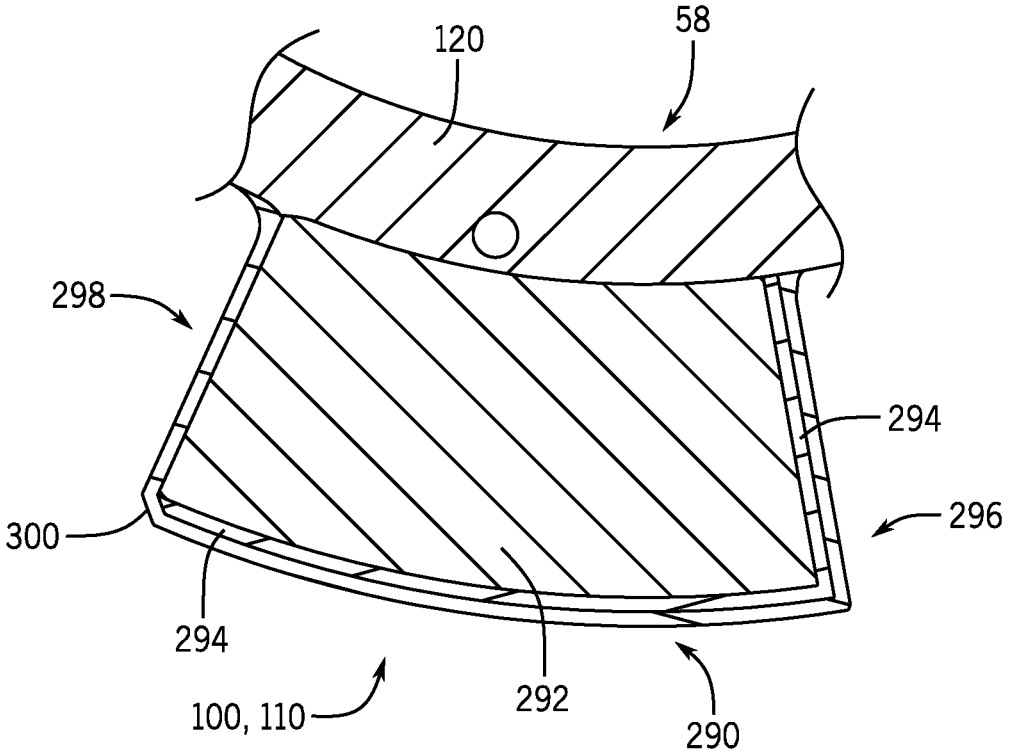
FIG. 11 is a cross-sectional top view of an impeller blade along line 11-11 of FIG. 5, according to an embodiment of the disclosure.

FIG. 11 is a cross-sectional view of an impeller blade 100 along line 11-11 of FIG. 5. As explained above and seen in FIGS. 2, 3, and 4, the inner and outer impellers sections 58, 64 are stacked on top of each other with the inner impellers sections 58 resting within a neighboring outer impeller section 64. This places a tip 290 of the impeller blade 100 proximate the interior circumferential surface 144 of the hub 140 of the outer impeller section 64, and likewise the tip of impeller blade 110 proximate the hub 120 of the inner impeller section 58. The clearance between the impeller blades 100, 110 and the inner and outer impellers sections 58, 64 is small (e.g., less than 1 mm or a few mm). As a result, the tip of the impeller blades 100, 110 are exposed to abrasive wear cause by particles bouncing between the tips of the impeller blades 100, 110 and the opposing hub 120, 140. In some embodiments, a coating or insert may therefore be applied to the tips of the impeller blades 100, 110 in the same manner as that of the leading edge described above.

For example, a core 292 of the impeller blade 100 may be made from a strong and tough material (e.g., a high-strength steel, nickel-based super alloy, or a titanium alloy). The impeller blade 100 may include an insert or coating 294 that couples to the core 292 along the tip 290. The insert or coating 294 may resist erosion from droplets and/or particulate that strikes and/or abrades against the tip 290. The insert or coating 294 extends along the tip 290 between the leading edge 296 and the trailing edge 298. The coating 264 may be attached to the impeller blade 100 using high velocity oxygen fuel (HVOF), high velocity air fuel (HVAF) and D-Gun thermal spray, plasma spray, laser cladding, and Conforma Clad brazing. The coating 294 may be made from tungsten carbide, tungsten carbide-metal composite, polycrystalline diamond, or other ceramics or ceramic-metal composites. If the coating 264 is in the form of an insert, the insert may be coupled to tip 290 of the impeller blade 100 by brazing, gluing, welding, and/or with a mechanical joint (e.g., dovetail joint or a joint using fasteners). The insert may be made from tungsten carbide, polycrystalline diamond, a metal ceramic composite, silicon nitride, silicon carbide, boron carbide, aluminum oxide, zirconia, or another ceramic.

As explained above, a coating 300 may be applied to the other surfaces that encounter low-angle impacts. For example, sprayed or vapor-deposited coatings may be used. Vapor deposited coatings may be applied to large surfaces in one operation, and the resulting coating is largely uniform with a smooth surface finish. The coating 300 may therefore not be polished or ground down after application. Other application methods may also be used, such as thermal spray methods or plasma spray methods. In some embodiments, the coating 300 may include titanium aluminum nitride. In other embodiments, the coating 300 may be titanium nitride, chromium nitride, chromium aluminium titanium nitride, a diamond like coating, or multiple layers of various of these and other coatings. The coating 300 may be uniformly deposited and/or applied to the leading edge 296, upper surface, lower surface, trailing edge 298, and/or the tip 290. If desirable, parts of the surface may not be coated. This can for instance be avoided by masking certain parts of the surface before application of the coating 300. While the discussion of FIG. 11 has focused on impeller blades 100 on the inner impeller sections 58, the discussion is equally applicable to the impeller blades 110 of the outer impeller sections 64.

Figure 12:
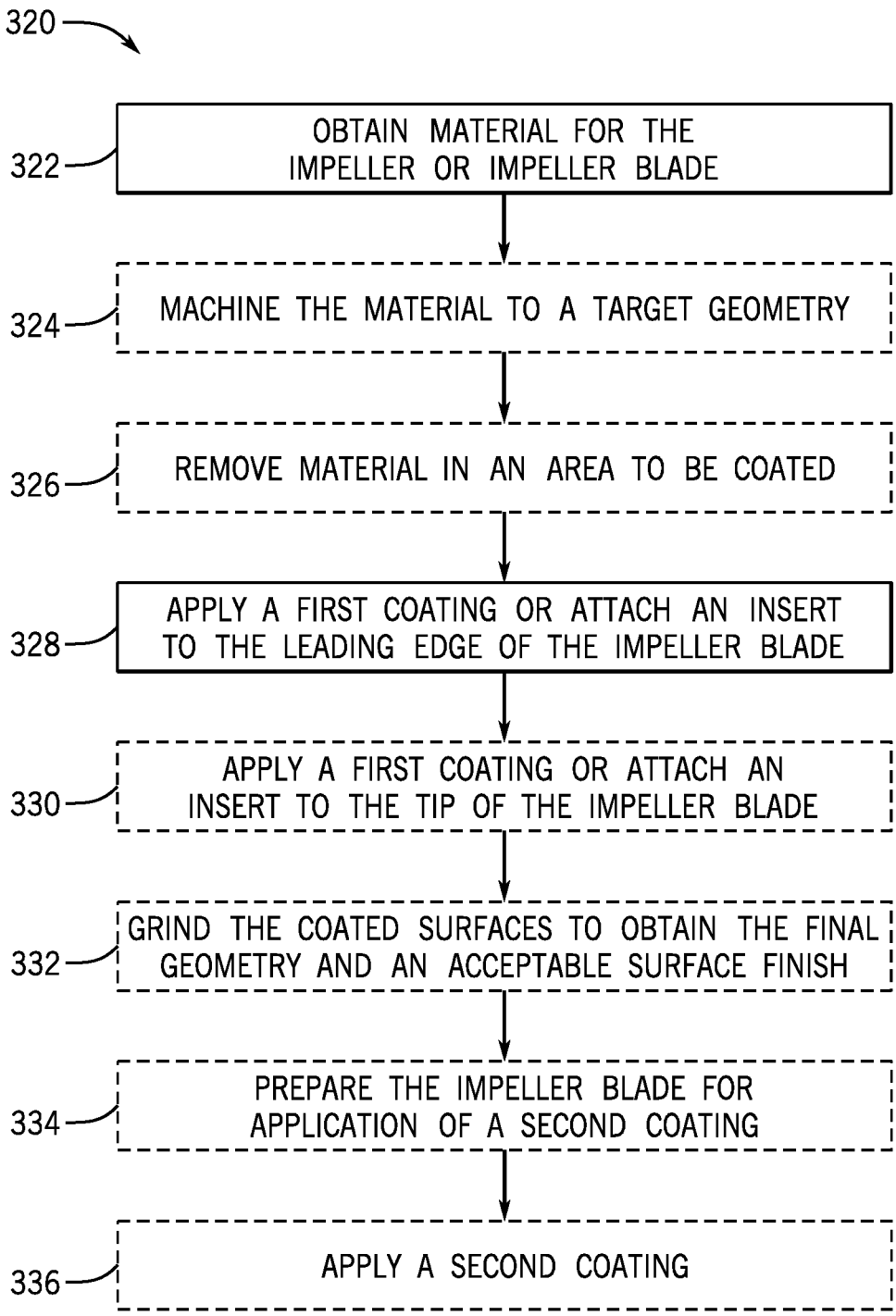
FIG. 12 is a method of manufacturing an impeller blade, according to an embodiment of the disclosure.

FIG. 12 is a method 320 of manufacturing an impeller blade (e.g., 100, 110) or impeller (e.g. 58, 64). The method 320 begins by obtaining material for the impeller or impeller blade, block 322. As explained above, the impeller blade material may include a high-strength steel, nickel-based super alloy, or a titanium alloy. The material may then be machined or otherwise formed to a target geometry, block 324. However, in some embodiments the impeller and/or impeller blade may be made by additive manufacturing and therefore the step in block 324 may be optional. In some embodiments, the method 320 may include an optional step of machining/forming a groove or grooves in the impeller blade by removing material (e.g., leading edge, tip), block 326. The grooves may facilitate placement of the coating and/or insert on the impeller blade. The method 320 then applies a first coating (i.e., hard and dense coating) or insert to the leading edge of the impeller blade, block 328. As explained above, the hard and dense coating or insert may include carbide, tungsten carbide-metal composite, polycrystalline diamond, or other ceramics or ceramic-metal composites. In some embodiments, the method 320 may include an optional step of applying a first coating (i.e., hard and dense coating) or insert to the tip of the impeller blade, block 330. As explained above, the tip of the impellers may be exposed to abrasive wear cause by particles bouncing between the tips of the impeller blades and the opposing hub. Accordingly, a coating or insert may therefore be applied to the tip in the same manner as to the leading edge as described above. After applying a hard and dense coating, the method 320 may include the optional step of grinding the coated surfaces (e.g., tip, leading edge) with the hard and dense material to obtain the final geometry and an acceptable surface, block 332. The method 320 continues by preparing the impeller blade for application of a second coating (e.g., a vapor deposited coating), block 334. This preparation may include masking coated surfaces (i.e., surfaces coated with the hard and dense coating) or inserts on the impeller blade. The method 320 may then apply a second coating to the impeller blade, such as by vapor deposition, block 336. In some embodiments, the second coating may cover the hard and dense coating as well as previously uncoated surfaces of the impeller blade. These surfaces may include the upper or first side surface, the lower or second side surface, the leading edge, the trailing edge, and/or the tip. In still other embodiments, the second coating may not be used and thus the steps in block 334 and 336 may be optional.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A compressor, comprising:

a first impeller section configured to rotate in a first direction; and a second impeller section configured to rotate in a second direction that is opposite the first direction, wherein the first and second impeller sections are axially aligned, and wherein the first impeller section and the second impeller section comprise:

an impeller blade with an impeller blade body constructed of a first material, the impeller blade body defining a leading edge configured to face a respective direction of rotation; and a second material coupled to a recessed portion on the leading edge, wherein the second material comprises a more erosion resistant than the first material, and wherein the second material is configured to extend over the leading edge a distance to absorb high angle impacts of droplets and/or particulate.

2. The compressor of claim 1, wherein the impeller blade body defines a tip along a length of the impeller blade body, wherein the second material couples to the tip.

3. The compressor of claim 1, wherein the second material is a coating.

4. The compressor of claim 1, wherein the second material is an insert.

5. The compressor of claim 1, wherein the second material includes tungsten carbide, tungsten carbide-metal composite, polycrystalline diamond or a combination thereof.

6. The compressor of claim 1, comprising a third material coupled to at least a portion of the impeller blade body.

7. The compressor of claim 6, wherein the third material coupled over an entire exposed surface of the impeller blade body, the third material forming a finished surface.

8. The compressor of claim 6, wherein the third material is a vapor-deposited coating.

9. The compressor of claim 8, wherein the vapor-deposited coating comprises titanium nitride, chromium nitride, titanium aluminum nitride, a diamond coating, or a combination thereof.

10. A method for manufacturing an erosion resistant impeller blade, comprising:

obtaining a first material for an impeller blade body;

machining the first material to form the impeller blade body; and coupling a second material to a recessed portion on a leading edge of the impeller blade body, wherein the second material is more erosion resistant than the first material, and wherein the second material is configured to extend over the leading edge a distance to absorb high angle impacts of droplets and/or particulate.

11. The method of claim 10, comprising coupling a third material to parts of or the entire impeller body, in addition to coupling the second material.

12. The method of claim 10, comprising coupling the second material to a tip of the impeller blade.

13. The method of claim 10, comprising removing at least some of the second material.

14. The method of claim 12, comprising grinding the second material coupled to the tip of the impeller blade.

15. The method of claim 10, comprising preparing the impeller blade body for application of a third material, wherein preparing comprises masking at least a portion of the second material.

16. An impeller blade, comprising:

an impeller blade body constructed of a first material, the impeller blade body defining a leading edge configured to face a direction of rotation;

a second material coupled to the leading edge, wherein the second material comprises a material that is more erosion resistant than the first material, and wherein the second material is configured to extend over a recessed portion on the leading edge a distance to absorb high angle impacts of droplets and/or particulate; and a third material coupled to at least a portion of the impeller blade body.

17. The impeller blade of claim 16, wherein the impeller blade body defines a tip along a length of the impeller blade body, wherein the second material is coupled to the tip.

18. The impeller blade of claim 16, wherein the second material is an insert.

19. The impeller blade of claim 16, wherein the third material is coupled over an entire exposed surface of the impeller blade body, the third material forming a finished surface.

* * * * *